US012588778B2

(12) United States Patent
Castaneda

(10) Patent No.: US 12,588,778 B2
(45) Date of Patent: Mar. 31, 2026

(54) UPLIFTED HANDS ASSIST DEVICE FOR PRAYING LIKE MOSES

(71) Applicant: Sergio Castaneda, Hobart, IN (US)

(72) Inventor: Sergio Castaneda, Hobart, IN (US)

( * ) Notice: Subject to any disclaimer, the term of this patent is extended or adjusted under 35 U.S.C. 154(b) by 0 days.

(21) Appl. No.: 19/196,600

(22) Filed: May 1, 2025

(65) Prior Publication Data

US 2025/0338988 A1 Nov. 6, 2025

Related U.S. Application Data

(60) Provisional application No. 63/641,306, filed on May 1, 2024.

(51) Int. Cl.
*A47G 33/00* (2006.01)

(52) U.S. Cl.
CPC ..... *A47G 33/008* (2013.01)

(58) Field of Classification Search
CPC ..... G09B 19/00; A47G 33/00; A47G 33/008; A61F 5/013; A61F 5/0118; A61H 2205/06
USPC ..... 434/245
See application file for complete search history.

(56) References Cited

U.S. PATENT DOCUMENTS 1,257,297 A * 2/1918 Brown ..... A61F 5/013 602/16
1,508,892 A * 9/1924 Mikalsen ..... A61H 1/0218 482/131
2,699,284 A * 1/1955 Rose ..... A62B 35/0037 119/857
2,801,142 A 7/1957 Adams
4,836,195 A * 6/1989 Berrehail ..... A61F 5/3753 D24/190
5,538,015 A * 7/1996 Paulson ..... A61F 5/0118 128/869
6,190,340 B1 * 2/2001 Borell ..... A61F 5/3738 2/45
6,626,408 B1 9/2003 Lorbiecki et al.
9,205,017 B2 * 12/2015 Doyle ..... A61F 5/013
9,404,618 B2 * 8/2016 Brown ..... F16M 11/2092
9,999,534 B2 * 6/2018 Doyle ..... A61F 5/0118
10,617,551 B2 * 4/2020 Doyle ..... A61F 5/013
(Continued)

OTHER PUBLICATIONS

Maker Pipe, T Connector, Retrieved From Internet, Retrieved on May 1, 2025, <URL: https://makerpipe.com/products/t-connector>.
(Continued)

*Primary Examiner* — Kurt Fernstrom
(74) *Attorney, Agent, or Firm* — Jin Wang; Thoughts to Paper

(57) ABSTRACT

The present invention provides an uplifted hands assist device for users to raise their hands in different positions while sitting, standing, or walking during praying. The device comprises an upper frame, a lower frame, and a vertical support holster. The upper frame includes a horizontal member, a vertical support member attached to the horizontal member, and two arm straps attached to the upper frame. The lower frame includes a telescoping tube fitted with the vertical support member of the upper frame, a locking mechanism to lock the relative position of the vertical support member of the upper frame to the telescoping tube, and two shoulder straps attached to the lower frame. The vertical support holster includes a pocket fitted to the end of the telescoping tube, and a belt to be tied to the waist of the user.

17 Claims, 15 Drawing Sheets

(56) References Cited

U.S. PATENT DOCUMENTS

| | | | | |
|---|---|---|---|---|
| 10,820,866 | B2 | 11/2020 | Campagna | |
| 10,857,021 | B2 * | 12/2020 | Mizera | A61H 1/0281 |
| 11,341,943 | B2 * | 5/2022 | Carrion Vaughn | F16M 11/2078 |
| 11,872,175 | B2 * | 1/2024 | Mizera | A61H 1/0274 |
| 2016/0339583 | A1 * | 11/2016 | Van Engelhoven | B25J 9/0006 |
| 2020/0375552 | A1 | 12/2020 | Campagna | |
| 2022/0219312 | A1 * | 7/2022 | Schirrmeister | A61F 5/013 |
| 2022/0228710 | A1 * | 7/2022 | Asbeck | F16M 13/04 |

OTHER PUBLICATIONS

Sunfex, Sunfex 2Pcs/Set 90 Degree Self-Locking Folding Hinges Brackets Spring Folding Hinge, Retrieved From Internet, Retrieved on May 1, 2025, <URL: https://makerpipe.com/products/t-connector>.

Heywood, Glorouschu Full Body Safety Harness Tool Fall Protection, OSHA/ANSI Compliant, ASTM F1774certified | Internal Shock Absorbing Lanyard ( Orange), Retrieved From Internet, Retrieved on May 1, 2025, <URL: https://www.amazon.com/Harness%EF%BC%8COSHA-Compliant-F1774certified-Absorbing-Lanyard%EF%BC%88Orange%EF%BC%89/dp/B07RZVZZ39>.

* cited by examiner

UPLIFTED HANDS ASSIST DEVICE FOR PRAYING LIKE MOSES

FIELD OF THE PRESENT INVENTION

The present invention relates generally to uplifted hands assist devices. Particularly, the present invention is a device that assists a user in raising their hands in various positions while sitting, standing, or walking.

BACKGROUND OF THE PRESENT INVENTION

Intercessors often pray while sitting, standing, or walking. During praying, an intercessor may wish to keep their hands raised. However, the act of keeping arms raised over a long period of time may be difficult. A prayer walk, for example, includes prayer while walking to or near a particular place. This type of prayer involves an additional physical burden on the intercessor.

The objective of the present invention is to provide a device that assists a user in raising their hands in different positions while sitting, standing, or walking. The present invention assists the user by hoisting their arms and reducing the burden.

SUMMARY OF THE PRESENT INVENTION

The present invention is a device that assists a user in raising their hands in different positions while sitting, standing, or walking. The device of the present invention comprises an upper frame, a lower frame, and a vertical support holster. The upper frame includes a horizontal member, and a vertical support member attached to a middle section of the horizontal member. The upper frame further includes two first arm straps attached to the upper frame and two second arm straps hung over loops of the first arm straps.

The lower frame includes a telescoping tube. The vertical support member of the upper frame is fitted into the telescoping tube and a locking mechanism on the telescoping tube locks the relative position of the vertical support member to the telescoping tube. The device further comprises a back support cushion and the vertical support holster, which has a pocket fit into end of the telescoping tube for further securing the device to the user. The uplifted hands assist device of present invention is attached to the user's shoulders, arms, hands, and waist.

BRIEF DESCRIPTION OF THE DRAWINGS

The uplifted hands assist device is the disclosure herein of exemplary embodiments of the present invention. It is distinctly claimed in the claims at the conclusion of this patent description. The forgoing and other features and advantages of the present invention will become more apparent from the following detailed description taken in conjunction with the accompanying drawings.

DETAILED DESCRIPTIONS OF THE INVENTION

All illustrations of the drawings are for the purpose of describing selected versions of the present invention and are not intended to limit the scope of the present invention.

The present invention is a device that assists a user in raising their hands in different positions while sitting, standing, or walking. The present invention comprises a horizontal member, a vertical support member, arm straps, and a telescoping tube. The present invention further comprises a back cushion and a waist belt. The device of the present invention is attached to the user's shoulders, arms, hands, or waist.

In some of the embodiments, the device of the present invention further comprises two transverse members attached to either end of the horizontal member.

In the preferred embodiment of the present invention, the uplifted hands assist device can collapse for portability using a telescoping tube. The device may be adjusted with detents and adjusting lock holes. The present invention is further able to fold or disassemble to reduce size for transportation or storage.

The present invention works as an uplifted hands assist device for the intercessor to pray while keeping the user's hands rested in comfort. Although the invention has been explained in relation to its preferred embodiments, it is to be understood that many other possible modifications and variations can be made without departing from the spirit and scope of the invention.

Figure 1:
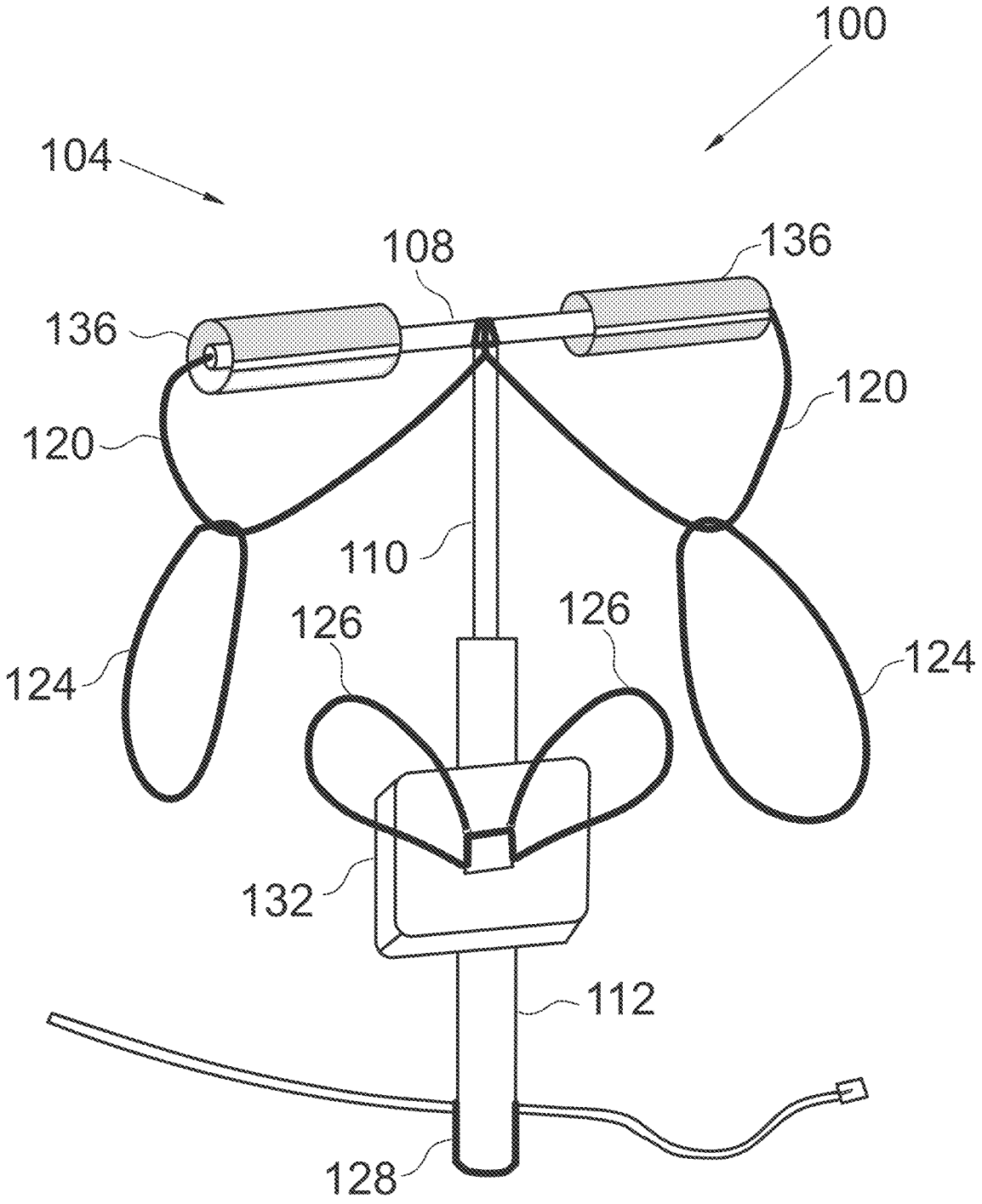
FIG. 1 is an isometric front side view of an uplifted hands assist device according to one of the embodiments of the present invention.

Referring to FIG. 1, there illustrated is an isometric front view of an uplifted hands assist device 100 according to one of the embodiments of the present invention. The uplifted hand assist device 100 comprises an upper frame 104, a lower frame 112, two first arm straps 120, two second arm straps 124 hung over the first arm straps 120, shoulder straps 126, a back support cushion 132, and a vertical support holster 128. The lower frame 112 comprises a telescoping tube, to which the vertical support member 110 is fitted in. The vertical support holster 128 is composed of a belt and a pocket. The pocket is to hold the end of the telescoping tube and the belt is for wrapping around the user's waist.

As shown in FIG. 1, the upper frame 104 includes a horizontal member 108 and a vertical support member 110 connected to the center of the horizontal member 108. The horizontal member 108 may be disconnected from the vertical support member 110 by disassembling it with wrenches. The horizontal member 108 of the upper frame 104 or the whole upper frame 104 is made of a conduit pipe. The first arm straps 120 are made of one strap passing through center of the horizontal member 108 with two ends coming out of the ends of the horizontal member 108. The ends of the strap are tied to the center of the horizontal member, forming two first arm straps 120. The two second arm straps 124 in shapes of loops are hung over the first arm straps 120. The arm straps 120 and 124 facilitate the ability of the user to hang user's hands, wrists, or forearms on the loops of the second or the first arm straps to pray like Moses.

The shoulder straps 126 are fixed to the telescoping tube of lower frame 112 through the back support cushion 132. The shoulder straps 126 facilitate the ability of the user to harness the shoulder straps and to stabilize the uplifted hands assist device 100 to the user's back. The shoulder straps 126 may be made from commercial Eder Flag Parade Carrying Belt Double Harness Web with adjustable harness size.

Referring to FIG. 1 again, the upper frame 104 further comprises two foam tubes 136 on either side of the upper frame to cover the horizontal member 108. Each of the foam tubes 136 has a slit for making it easy to install the foam tube 136 on the horizontal member 108. The relative position of the vertical support member to the telescoping tube is adjustable by the user. The back support cushion 132 is attached to the lower frame 112 for supporting the back of the user. The vertical support holster 128 is located below the back support cushion, also attached to the lower frame 112. The holster 128 may be a flagpole harness pouch, which is tied to the vertical support member 110. The belt of the vertical support holster 128 is tied around the user's waist to provide further support for the device.

Figure 12:
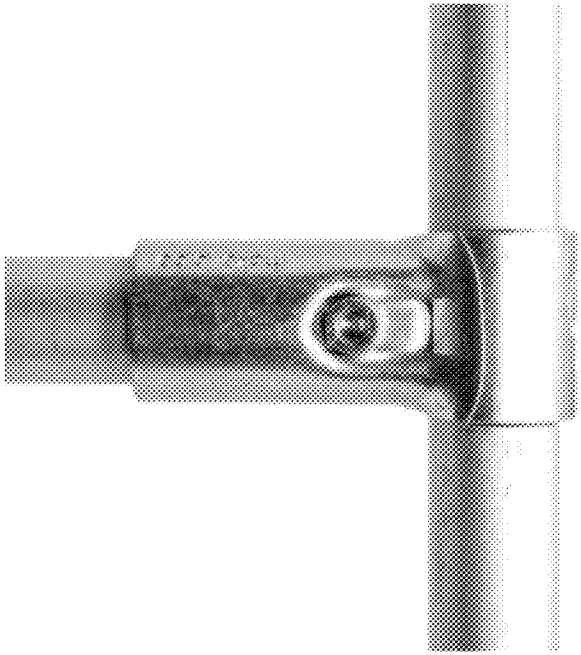
FIG. 12 (Prior Art)
FIG. 12 is a photo of a commercial T connector; and the T connector is used for connecting the horizontal member to the vertical support member in FIGS. 1 and 2.

Alternatively, the first arm straps 120 may be fastened with a clamp or zip to the horizontal member 108. Or the first arm straps 120 may be tied, or screwed, or bolted to the outside of the horizontal member 108. The shoulder straps 126 may be used as a web harness. The vertical support member 110 and the horizontal member 108 may be attached to each other by wood screws or bolted by metal angles. Or the vertical support member and the horizontal member may be made of one piece, shown in FIG. 7. Furthermore, the vertical support member and the horizontal member may be attached to each other by a commercial T-connector. The commercial T-connector is shown in FIG. 12. The back support cushion 132 may be fastened to the lower frame 112 by straps built into the cushion. Or the cushion 132 may be zip tied or screwed or bolted to the lower frame 112.

Figure 2:
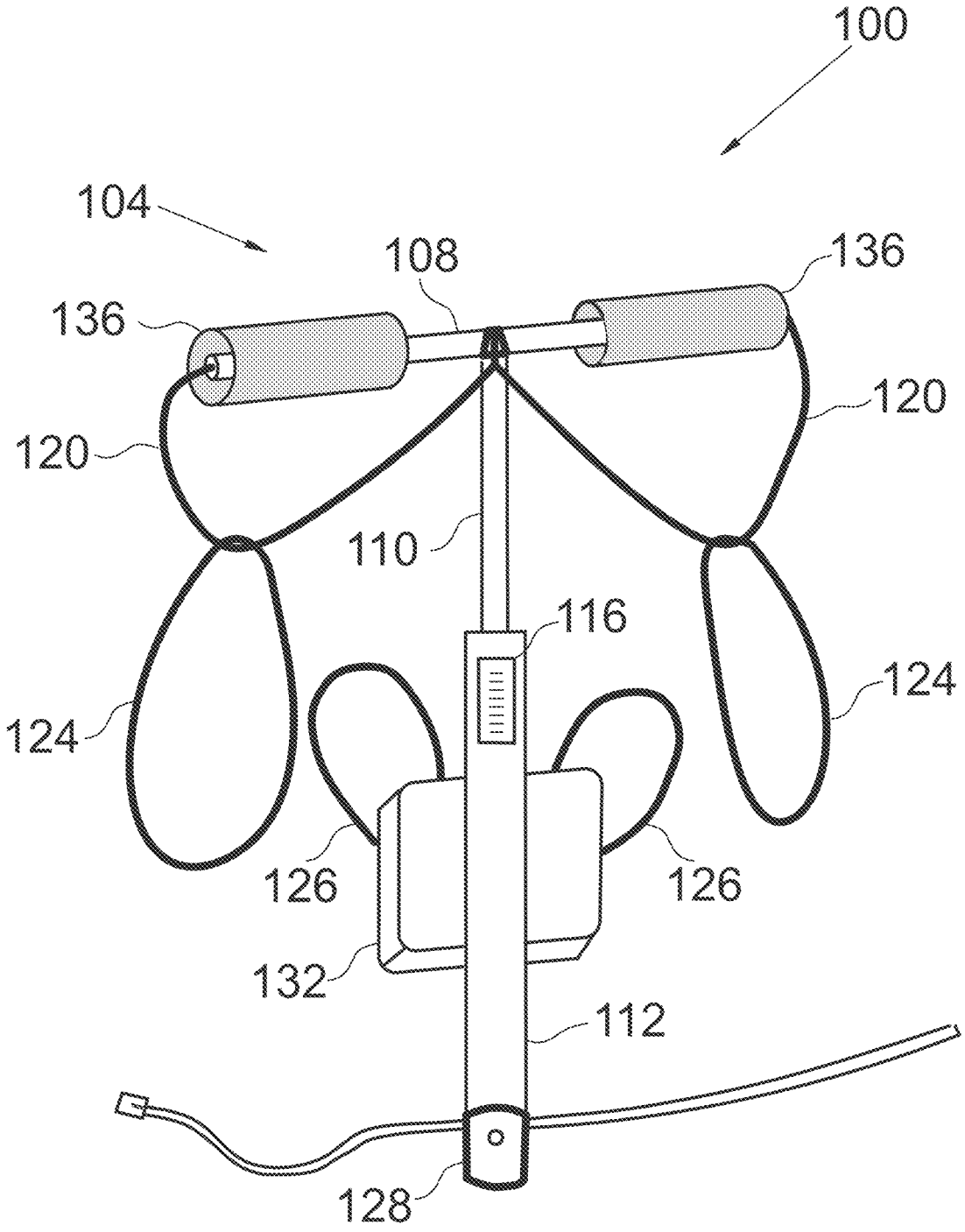
FIG. 2 is an isometric back side view of the uplifted hands assist device according to the embodiment shown in FIG. 1.

Referring to FIG. 2, there illustrated is an isometric back side view of the uplifted hands assist device according to the embodiment shown in FIG. 1. As shown in FIG. 2, the telescoping tube of the lower frame 112 comprises a locking mechanism 116 that locks the relative position of the vertical support member 110 with the telescoping tube of the lower frame 112. As a result, the overall length of the uplifted hands assist device 100 is adjustable by the locking mechanism 116 to suit the user's need. Preferably, the horizontal member 108 is several centimeters away from the user's face and above the user's hands so that the user can reach up and hang the hands on the loops of the first or the second arm straps.

Figure 3:
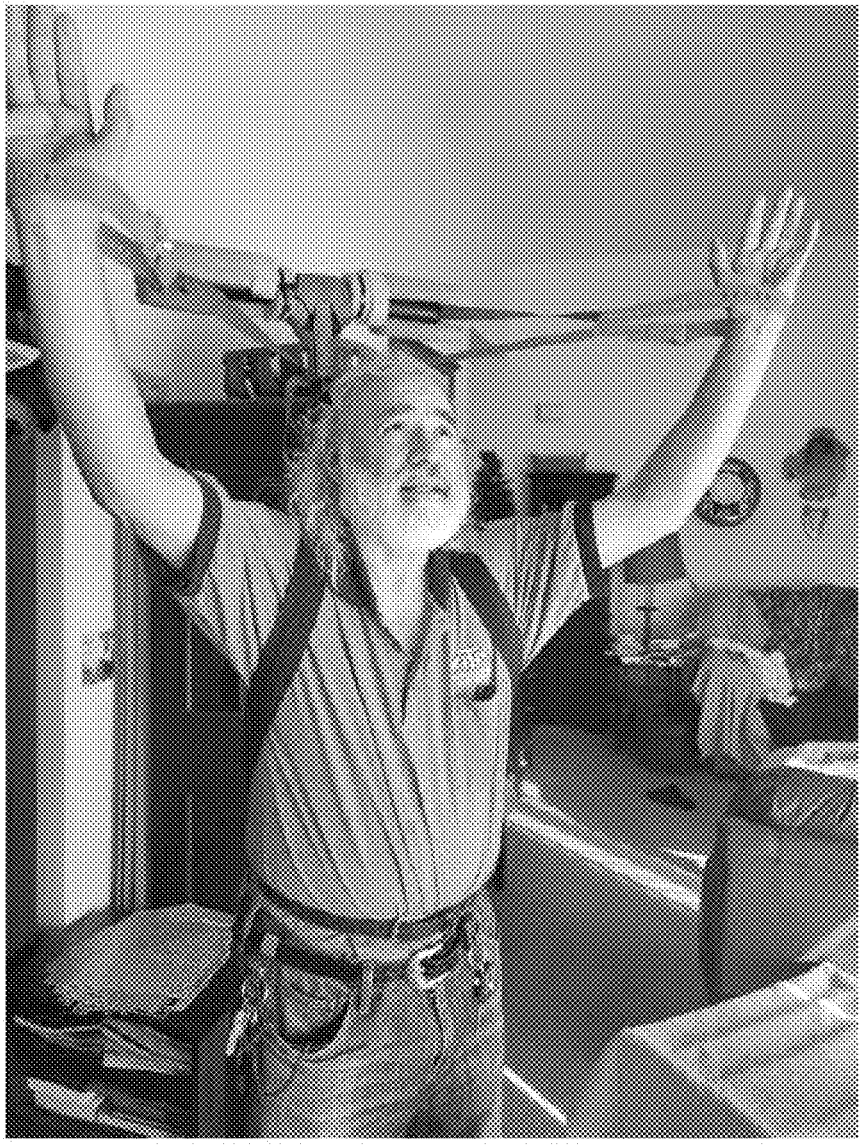
FIG. 3 is a photo of a user using the uplifted hands assist device according to the embodiment shown in FIGS. 1 and 2.

Referring to FIG. 3, there illustrated is a photo of a user using the uplifted hands assist device according to the embodiment shown in FIGS. 1 and 2. As shown in the photo, the upper frame 104 is behind the user, the horizontal member 108 is slightly above the user's head, the raised hands of the user are supported by the second arm straps 124, and the belt of the vertical support holster 128 is tied to the waist of the user for providing further support to the device.

Figure 4:
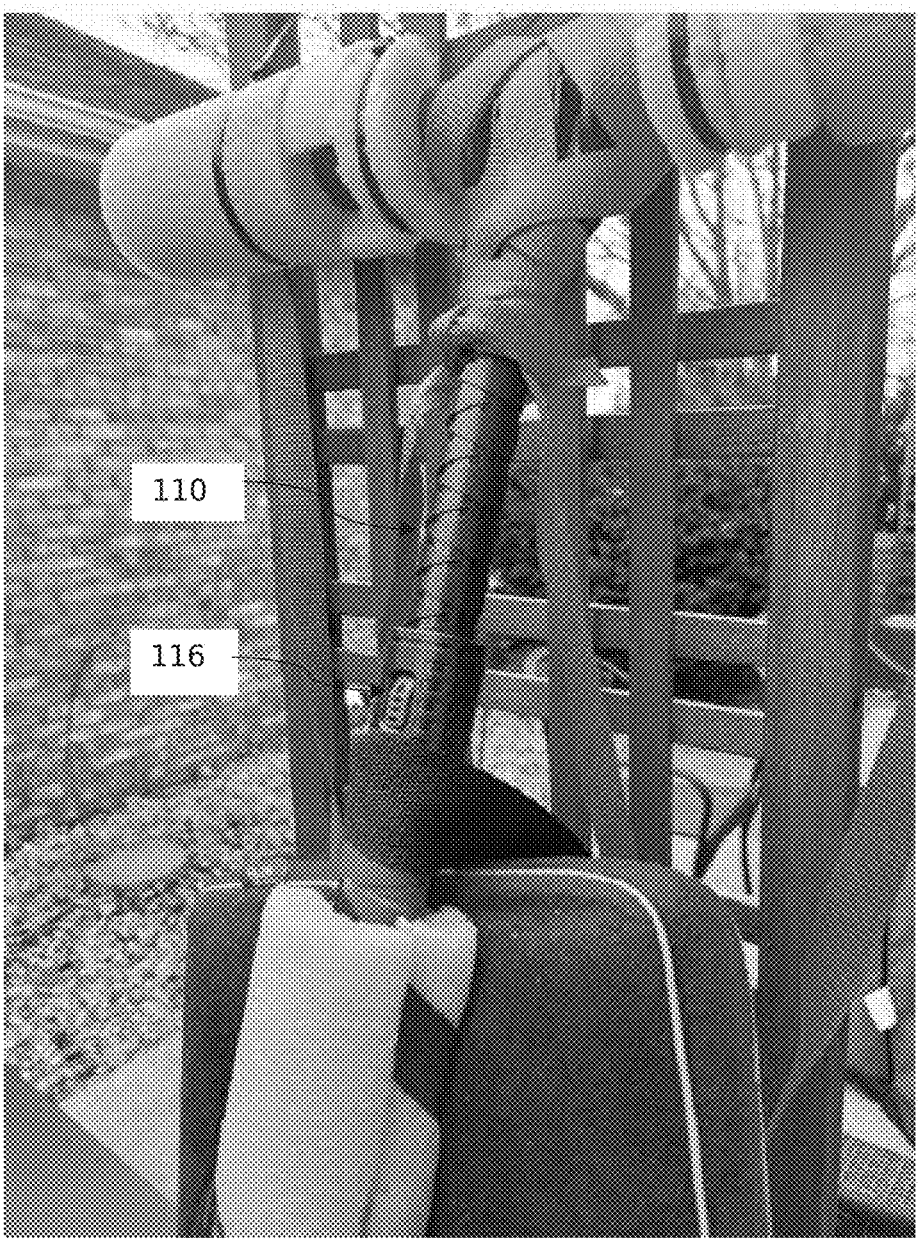
FIG. 4 is a photo of the back side view of the uplifted hands assist device according to the embodiment shown in FIGS. 1 and 2.

Referring to FIG. 4, there illustrated is a photo of the back side view of the uplifted hands assist device according to the embodiment shown in FIGS. 1 and 2. As shown in FIG. 4, the strap for making the first arm strap 120 is wrapped around the center of the horizontal member 108, ends of which are tied to a top section of the vertical support member 110.

Referring to FIG. 4 again, the back support cushion 132 is bound to the lower frame 112 through a layer of foam wrapped around the lower frame 112 such that the foam provides more contact area with the cushion 132. The locking mechanism 116 is installed on the telescoping tube of the lower frame 112. The surface of the vertical support member 110 has graded curves which assist in locking the vertical support member 110 with the telescoping tube by the locking mechanism 116.

Figure 5:
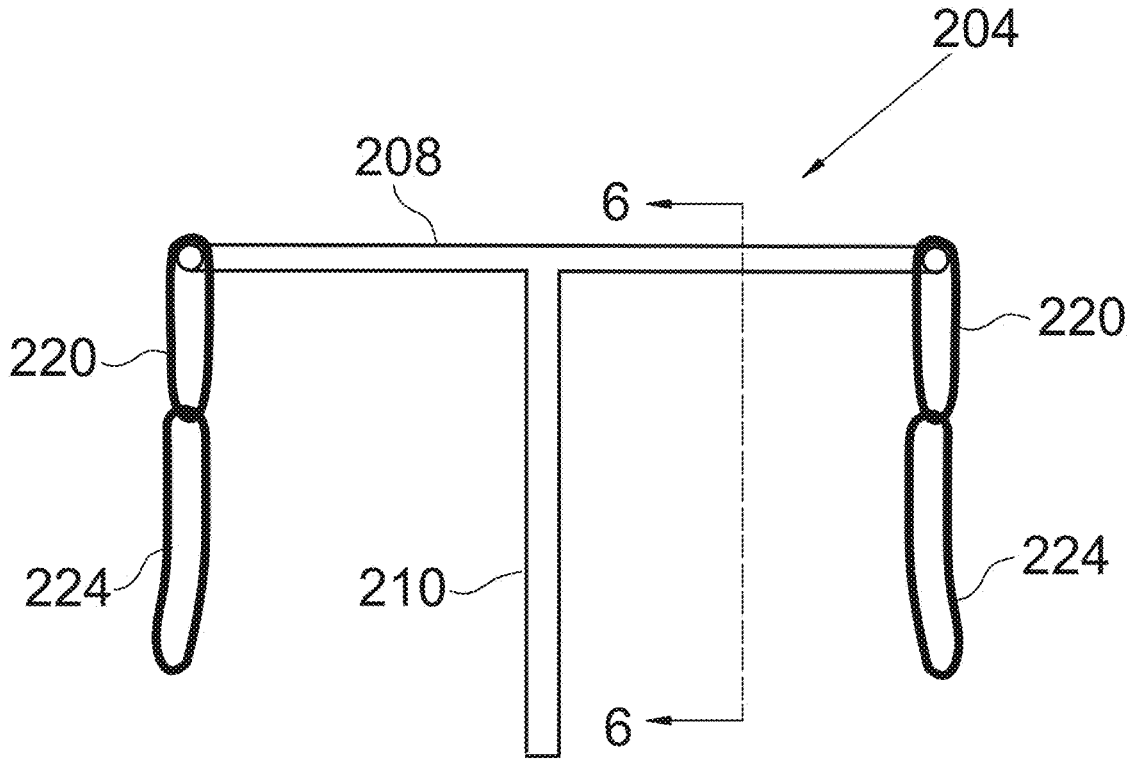
FIG. 5 is a front side view of an upper frame of an uplifted hands assist device according to another one of the embodiments of the present invention.

Referring to FIG. 5, there illustrated is a front side view of an upper frame of an uplifted hands assist device according to another one of the embodiments of the present invention. As shown in FIG. 5, the upper frame 204 comprises a horizontal member 208, a vertical support member 210, two first arm straps 220, and two second arm straps 224 hung over loops of the first arm straps 220.

Figure 6:
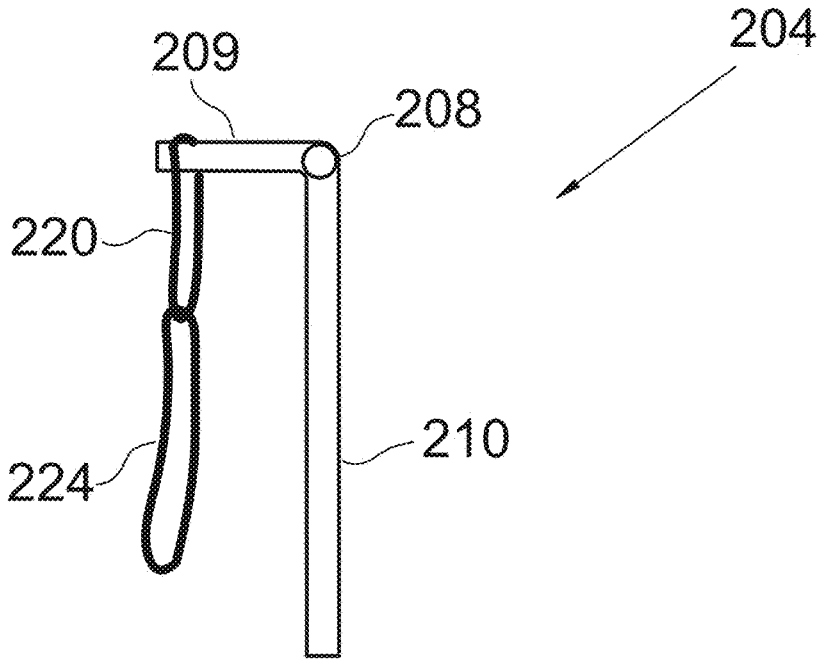
FIG. 6 is a cross-sectional view of the upper frame of FIG. 5 taken along the lines 6-6 of FIG. 5.

Referring to FIG. 6, there illustrated is a cross-sectional view of the upper frame of FIG. 5 taken along the lines 6-6 of FIG. 5. As shown in FIG. 6, the upper frame 204 further comprises two transverse members 209 perpendicular to the horizontal member 208. One end of each transverse member 209 is attached to either end of the horizontal member 208. The transverse member 209 can be detached form the horizontal member 208 from a T connection via a detent system. The first arm straps 220 are attached to the other ends of the transverse member 209. The configuration of the upper frame 204 of this embodiment moves the arm straps 220 and 224 forward to the front of user. The transverse members 209 can be made of wood or a tube. They make the arm straps more reachable to the user.

The first arm straps 220 may be fastened to the transverse members by a clamp, or a zip. Alternatively, the first arm straps 220 may be tied, or screwed, or bolted to the transverse members 209. The upper frame 204 may be fitted into a lower frame like the lower frame 112 displayed in FIGS. 1 and 2.

Figure 7:
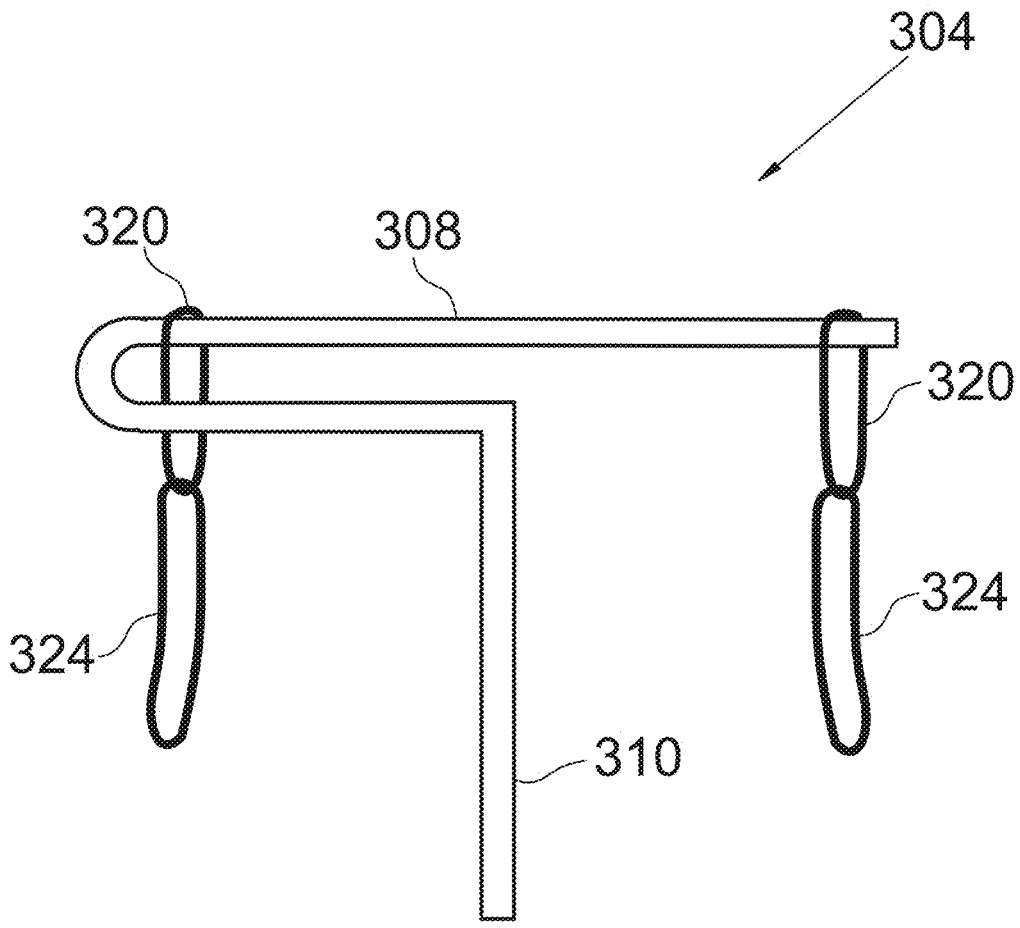
FIG. 7 is a back side view of an upper frame of an uplifted hands assist device according to yet another one of the embodiments of the present invention.

Referring to FIG. 7, there illustrated is a back side view of an upper frame of an uplifted hands assist device according to yet another one of the embodiments of the present invention. As shown in FIG. 7, the upper frame 304 comprises a horizontal member 308, a vertical support member 310, two first arm straps 320, and two second arm straps 324. The horizontal member 308 and the vertical support member 310 are made of one piece of conduit or pipe. The conduit or pipe for making the horizontal member 308 and the vertical support member 310 is bent in a U turn with one section used as the horizontal member 308 and the other section bent downward to form the vertical support member 310.

The upper frame 304 of this embodiment is envisioned to be prompted to serve the suspension of the user's hands or forearms. The upper frame 304 may be fitted into a lower frame like the lower frame 112 displayed in FIGS. 1 and 2.

Figure 8:
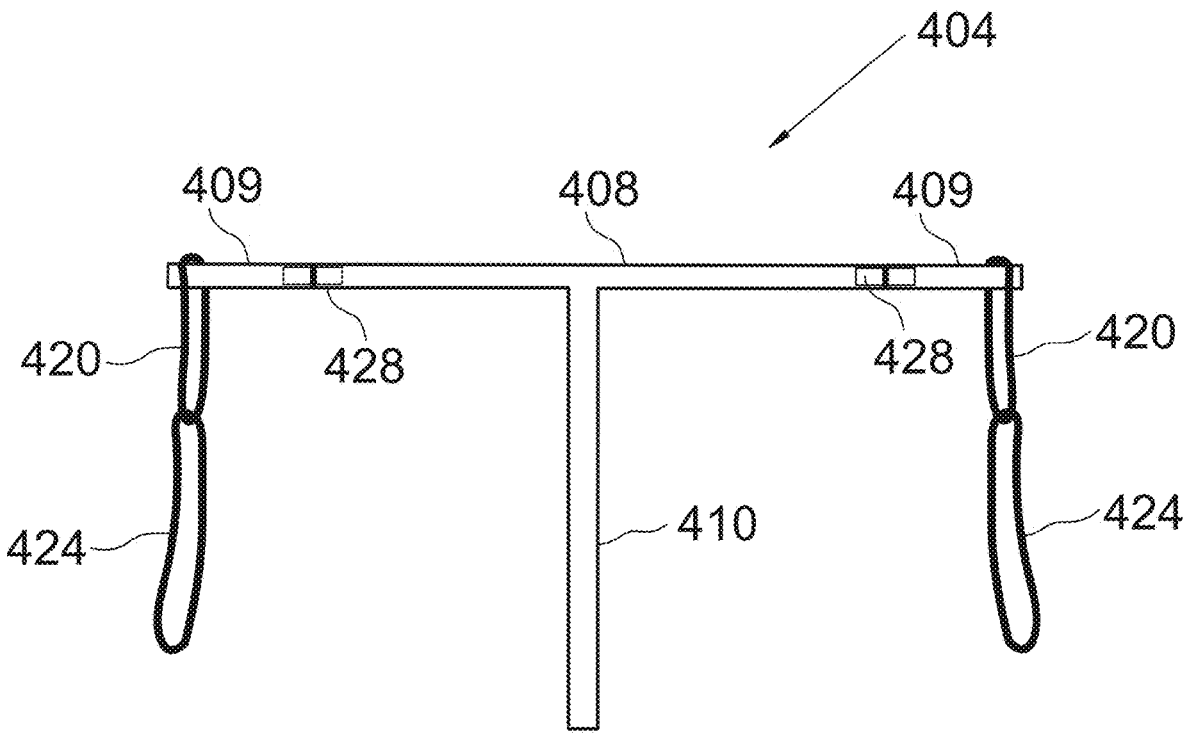
FIG. 8 is a front side view of an upper frame of an uplifted hands assist device in an extended configuration according to yet another one of the embodiments of the present invention.

Referring to FIG. 8, there illustrated is a front side view of an upper frame of an uplifted hands assist device in an extended configuration according to yet another one of the embodiments of the present invention. As shown in FIG. 8, the upper frame 404 comprises a horizontal member 408, two extension members 409 connected to the horizontal member 408 by hinges 428, a vertical support member 410, two first arm straps 420, and two second arm straps 424. The hinges 428 are in an extended configuration so that the extension members 409 are linearly connected to the horizontal member 408.

Figure 9:
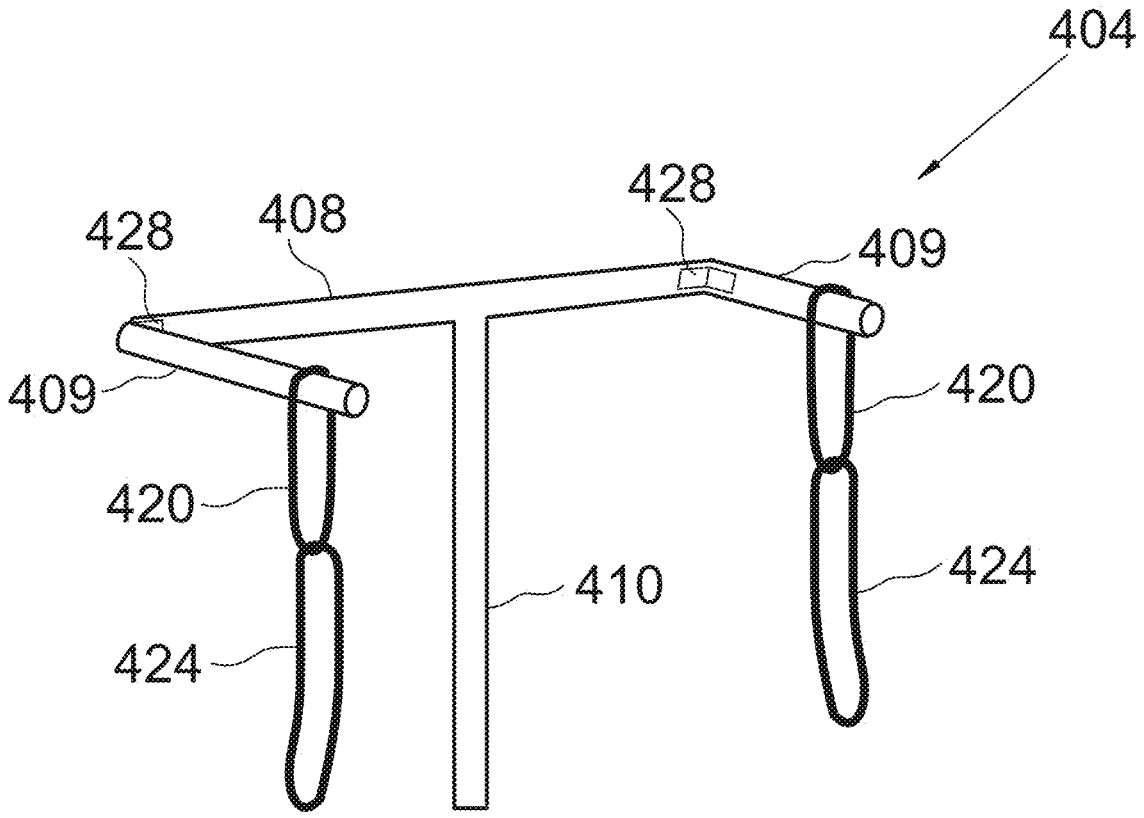
FIG. 9 is an isometric view of the upper frame of the uplifted hands assist device displayed in FIG. 8 in a folded configuration according to the embodiment of the present invention.

Referring to FIG. 9, there illustrated is an isometric view of the upper frame of the uplifted hands assist device displayed in FIG. 8. As shown in FIG. 9, the hinges 428 are in a folded configuration so that the extension members 409 are perpendicular to the horizontal member 408. Being attached to the corresponding ends of the extension members 409, the arm straps 420 and 424 are moved forward to the front of user, which is more reachable for the user. The upper frame 404 may be fitted into a lower frame like the lower frame 112 displayed in FIGS. 1 and 2.

Figure 10:
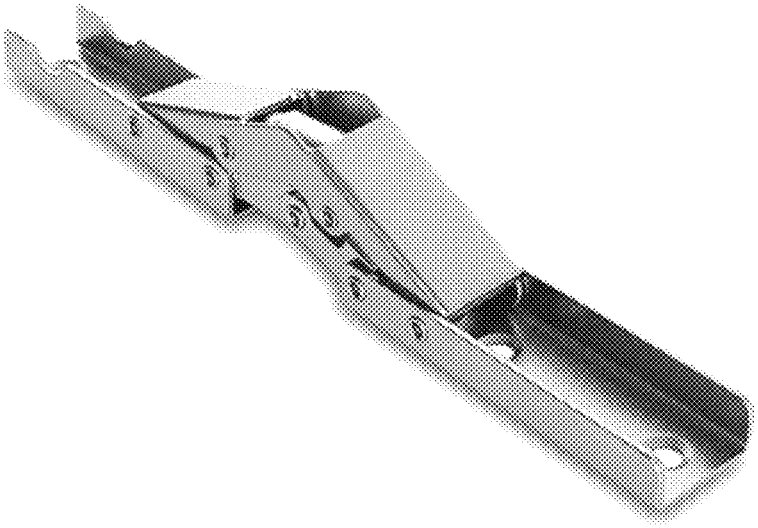
FIG. 10 (Prior Art)
FIG. 10 is a photo of a commercial spring folding hinge in extended configuration, and the hinge is used for the upper frame of the uplifted hands assist device of FIG. 8 according to the embodiments of the present invention.

Referring to FIG. 10, there illustrated is a photo of a commercial spring folding hinge in extended configuration. The spring is spring folding, self-locking, and foldable. The hinge may be used for the upper frame of the uplifted hands assist device of FIG. 8 according to one of the embodiments of the present invention.

Figure 11:
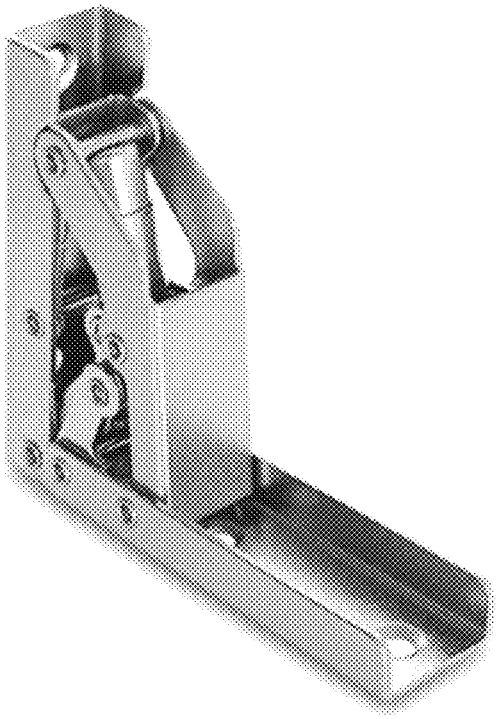
FIG. 11 (Prior Art)
FIG. 11 is a photo of a commercial spring folding hinge in a folded configuration, and the hinge is used for the upper frame of the uplifted hands assist device of FIG. 9 according to the embodiments of the present invention.

Referring to FIG. 11, there illustrated is a photo of the commercial spring folding hinge in a folded configuration. The hinge may be used for the upper frame of the uplifted hands assist device of FIG. 9 according to one of the embodiments of the present invention.

Referring to FIG. 12, there illustrated is a photo of a commercial T-connector. The commercial T connector is designed for versatile pipe connection of two pipes at a 90-degree angle. The T connector consists of two pieces interlocked together with one nut and bolt. The T connector is designed for quick change of a connection while building or removing and reusing the connector. The T connector may be used for connecting the horizontal member 108 and vertical support member 110 in FIGS. 1 and 2. When the T connector is removed from the uplifted hands assist device 100, the device 100 could be reassembled as an uplifted hands assist device 500 shown in FIG. 13.

Figure 13:
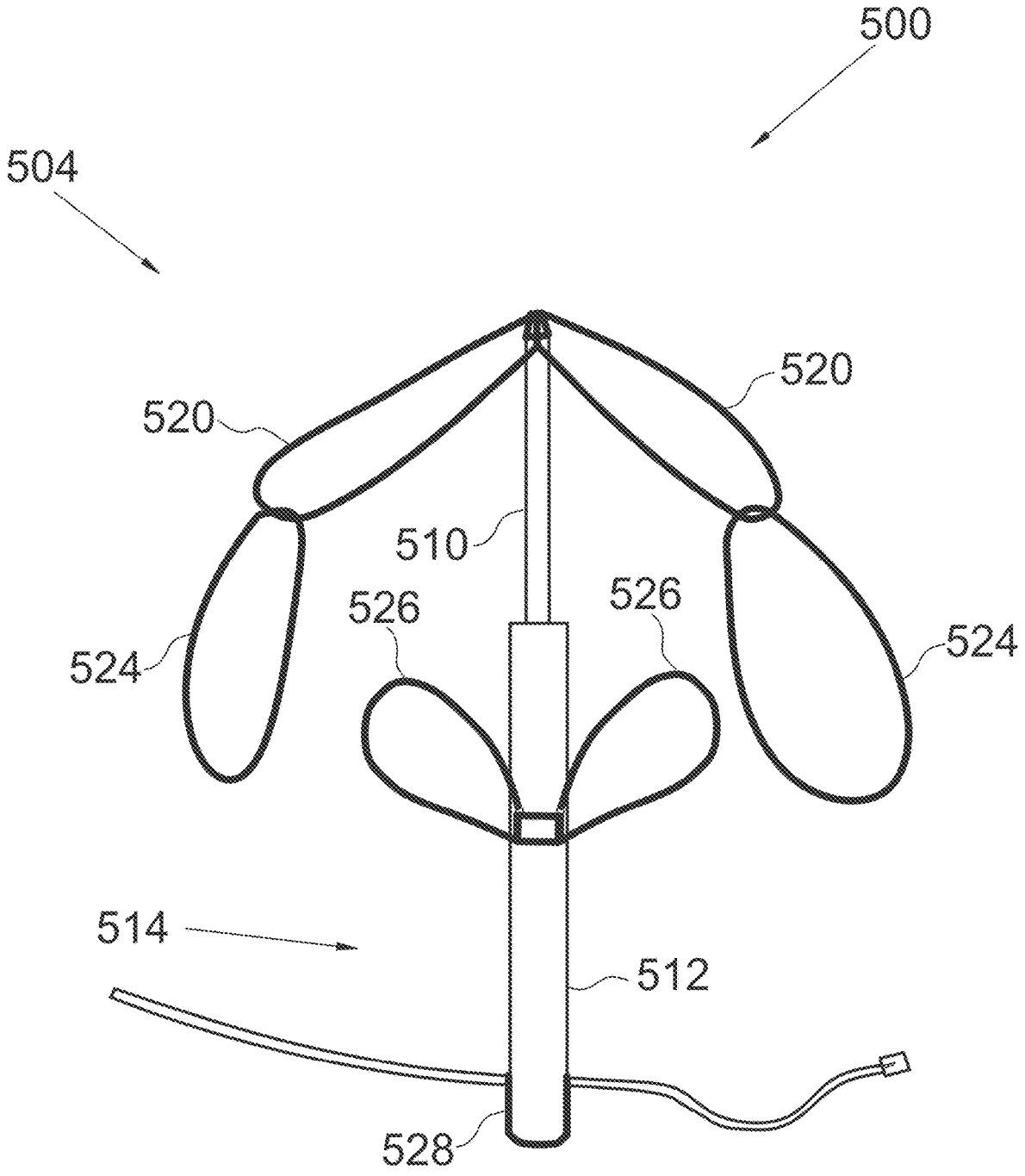
FIG. 13 a front side view of an uplifted hands assist device according to another one of the embodiments of the present invention.

Referring to FIG. 13, there illustrated is a front view of an uplifted hands assist device 500 according to another one of the embodiments of the present invention. The uplifted hands assist device 500 is like the uplifted hands assist device 100 in most parts except missing the horizontal member 108.

The uplifted hand assist device 500 comprises an upper frame 504, a lower frame 514, two first arm straps 520 attached to top end of the vertical support member 510, two second arm straps 524 hung over the first arm straps, arm straps 526, and a vertical support holster 528. The lower frame 514 comprises a telescoping tube 512, to which the vertical support member 510 is fitted in. The vertical support holster 528 is composed of a belt and a pocket. The pocket is to hold the end of the telescoping tube 512 and the belt is for wrapping around the user's waist.

Figure 14:
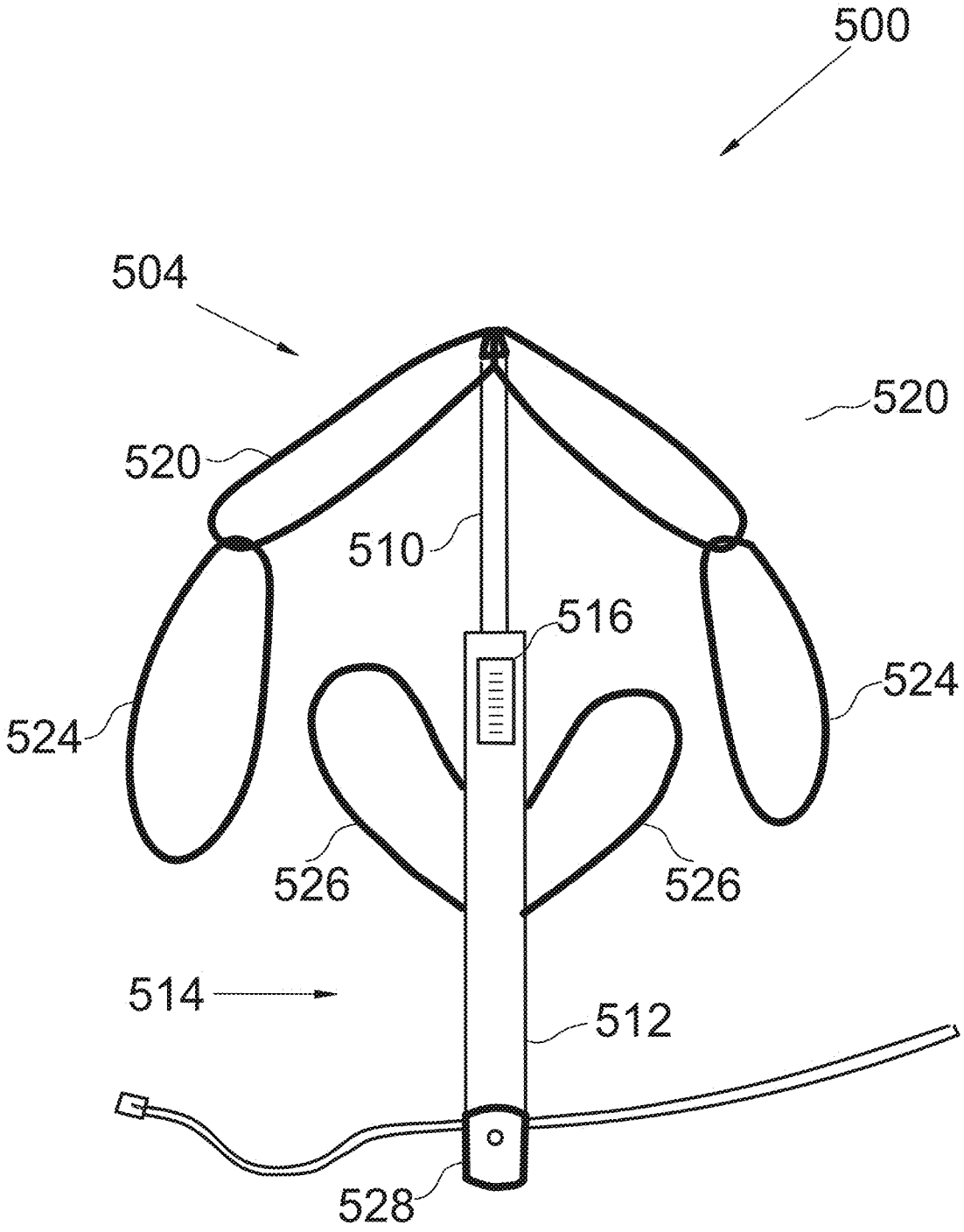
FIG. 14 a back side view of an uplifted hands assist device according to the embodiment shown in FIG. 13.

Referring to FIG. 14, there illustrated is an isometric back side view of the uplifted hands assist device 500 according to the embodiment shown in FIG. 13. As shown in FIG. 14, the telescoping tube 512 of the lower frame 514 comprises a locking mechanism 516 that locks the relative position of the vertical support member 510 with the telescoping tube 512. As a result, the overall length of the uplifted hands assist device 500 is adjustable by the locking mechanism 516 to suit the user's need.

Figure 15:
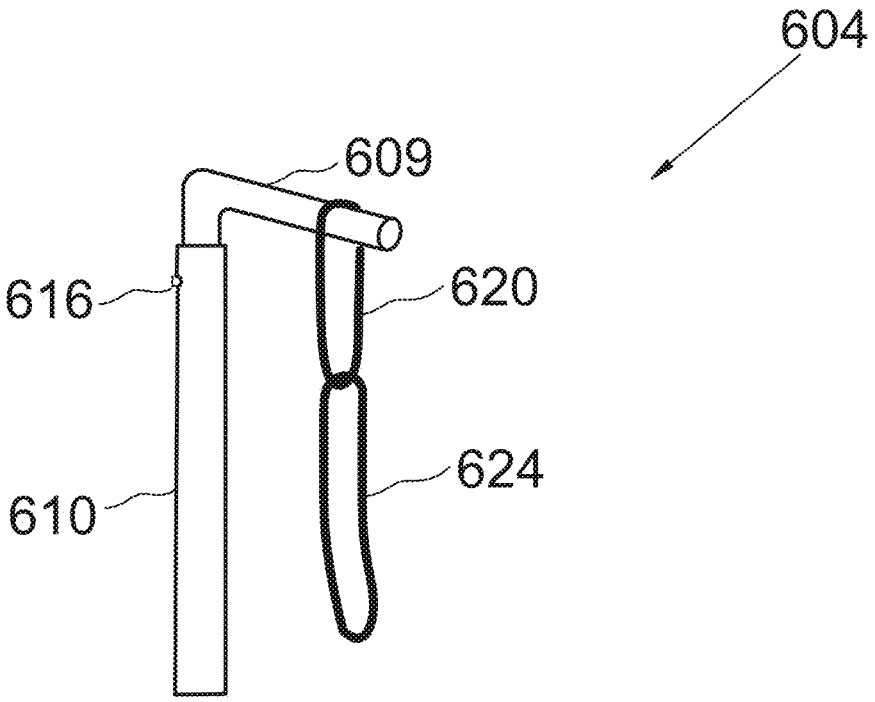
FIG. 15 is an isometric front side view of an upper frame with an attached arm strap of an uplifted hands assist device according to another one of the embodiments of the present invention.

Referring to FIG. 15, there illustrated is an isometric view of an upper frame 604 that can fit to the lower frame of the uplifted hands assist device of either 100 or 500. The upper frame 604 comprises a vertical support member 610, a transverse member 609 pointing forward, a first arm strap 620, and a second arm strap 624. The upper frame 604 further comprises a fastening mechanism 616 which connects the vertical support member 610 with the transverse member 609. The fastening mechanism 616 enables the connection to be detachable.

Figure 16A:
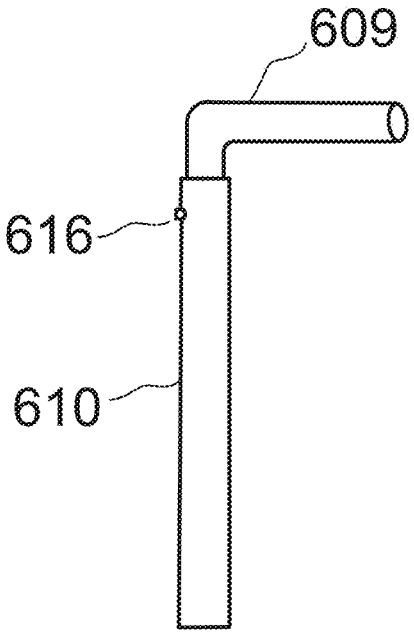
FIG. 16*a* is a left side view of the upper frame shown in FIG. 15
Figure 16B:
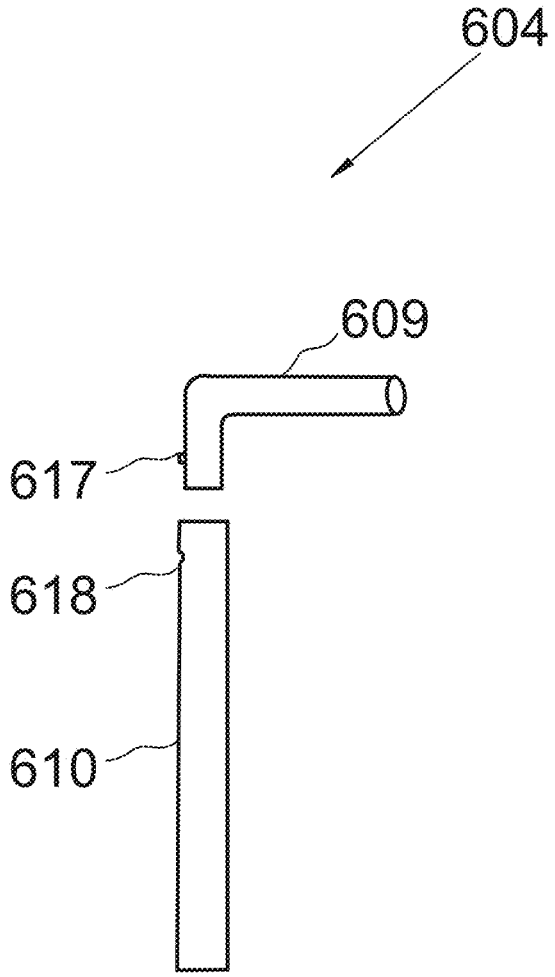
FIG. 16*b* is a left side view of disconnected upper frame of the FIG. 16*a*.

Referring to FIG. 16*a*, there illustrated is a left side view of the upper frame 604 shown in FIG. 15. Referring to FIG. 16*b*, there illustrated is a left side view of disconnected upper frame 604 of the FIG. 16*a*. As shown in FIG. 16*b*, the transverse member 609 further includes a male fastening mean 617 and the vertical support member 610 includes a female fastening mean 618. When connected, the fastening mean 617 of the transverse member 609 is fit to the female fastening mean 618 of the vertical support member 610.

Figure 17:
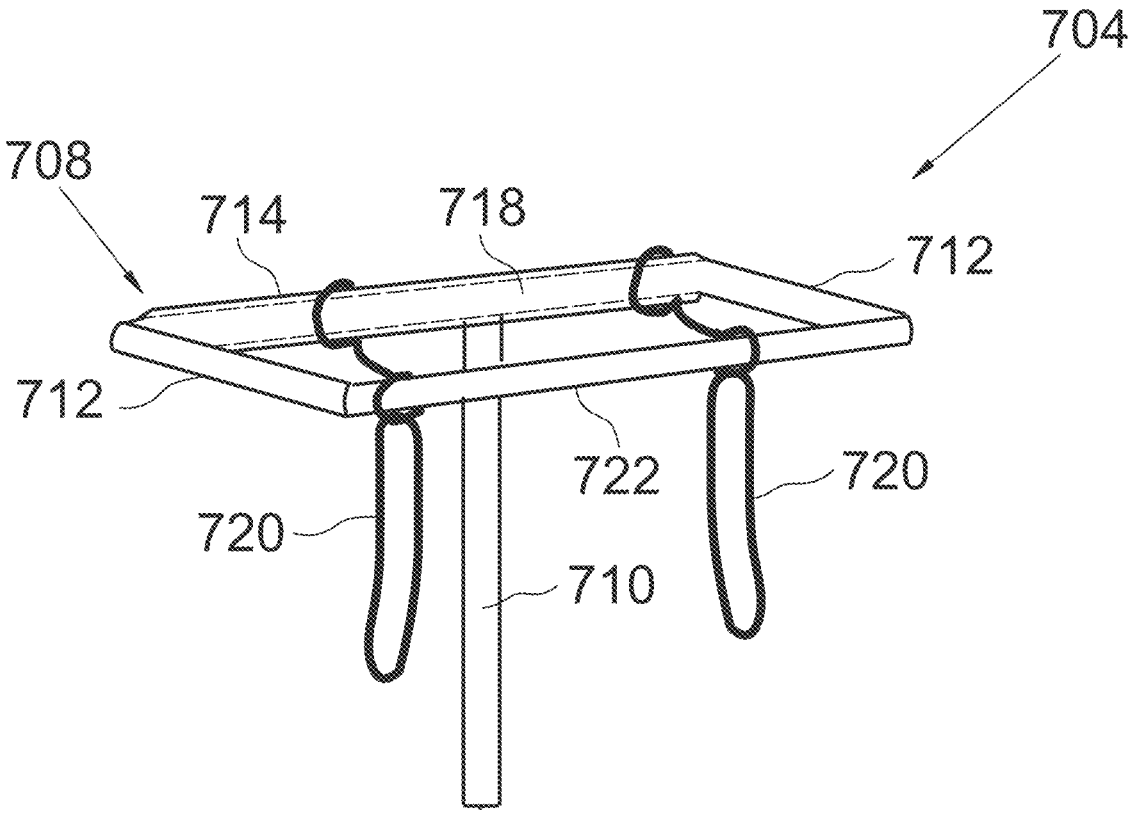
FIG. 17 is an isometric view of an upper frame of the uplifted hands assist device according to another one of the embodiments of the present invention.

Referring to FIG. 17, there illustrated is an isometric view of an upper frame of the uplifted hands assist device according to another one of the embodiments of the present invention. As shown in FIG. 17, the upper frame 704 comprises a horizontal member 708 in the form of rectangular frame, a vertical support member 710, and arm straps 720 hanging over the horizontal member 708. The horizontal member 708 is made of a front bar 722, a rear bar 718 and two transverse bars 712. The rear bar 718 is further covered by an outer shell 714 which is connected to the vertical support member 710. The rear bar 718 is rotatable within the outer shell 714 so that the horizontal member 708 can be rotated upward or downwards before the position of the horizontal member 708 is pin locked in place.

The upper frames 104, 204, 304, 404, 504, 604, and 704 may be made from tube, conduit, or pipe. However, the upper frames may also be made of solid rods. The cross-sections of the tube, conduit, or pipe for the upper frame may be in the shape of a round circle, square, or any other shape.

The upper frames and lower frames may be made of the same material or different materials. The materials is selected from a group including plastics, woods, metals, or metal alloys.

What is claimed is:

1. An uplifted hands assist device comprising:

an upper frame including a horizontal member and a vertical support member attached to the horizontal member;

two first arm straps attached to the upper frame;

a lower frame including a telescoping tube, wherein the vertical support member of the upper frame is fitted into the telescoping tube, and a locking mechanism is attached to the telescoping tube to lock the relative position of the vertical support member to the telescoping tube;

two shoulder straps attached to the lower frame; and a vertical support holster attached to the lower frame, the vertical support holster including a pocket fitted to the end of the telescoping tube and a belt to be tied to the waist of the user.

2. The uplifted hands assist device of claim 1 further comprising two second arm straps, each one of the second arm straps hung over a loop of one of the first arm straps.

3. The uplifted hands assist device of claim 1 further comprising a back support cushion attached to the lower frame for providing support to back of a user.

4. The uplifted hands assist device of claim 1 further comprising two foam tubes to cover either side of the horizontal member of the upper frame.

5. The uplifted hands assist device of claim 1, wherein the upper frame further comprises two transverse members attached to either end of the horizontal member, the transverse members being perpendicular to the horizontal member to point forward, and wherein each one of the first arm straps is attached to one of the ends of the transverse members such that the arm straps are in front of the user and more reachable to the user.

6. The uplifted hands assist device of claim 1, wherein the shoulder straps are adjustable in size.

7. The uplifted hands assist device of claim 1, wherein the upper frame further comprises two extension members, each of the extension members connected to one of the ends of the horizontal member through a hinge so that the extension members are rotatable horizontally, and wherein each one of the first arm straps are attached to one of the ends of the extension members.

8. The uplifted hands assist device of claim 1, wherein the horizontal member and the vertical support member of the upper frame are formed of one piece of tube, pipe, or conduit.

9. The uplifted hands assist device of claim 1, wherein the horizontal member and the vertical support member of the upper frame are made of a conduit.

10. The uplifted hands assist device of claim 1, wherein a material for making the horizontal member and the vertical support member is selected from a group including metals, metal alloys, and plastics.

11. The uplifted hands assist device of claim 1, wherein a material for making the telescope tube is selected from a group including metals, metal alloys, and plastics.

12. An uplifted hands assist device comprising:

an upper frame and a lower frame, the upper frame including a vertical support member and the lower frame including a telescoping tube, wherein the vertical support member is fitted into the telescoping tube;

two first arm straps attached to the top of the upper frame and two second arm straps, each one of the second arm strap hung over a loop of one of the first arm straps;

a locking mechanism attached to the telescoping tube to lock the relative position of the vertical support member to the telescoping tube;

two shoulder straps attached to the lower frame; and a vertical support holster attached to the lower frame, the vertical support holster including a pocket fit to the end of the telescoping tube and a belt to be tied to the waist of the user.

13. The uplifted hands assist device of claim 12, wherein the upper frame further comprises a transverse member attached to the top of the vertical support member, the transverse member perpendicular to the vertical support member to point forward, and wherein each one of the first arm straps is attached to the end of the transverse members such that the arm straps are in front of the user and more reachable to the user.

14. The uplifted hands assist device of claim 12, wherein the shoulder straps are adjustable in size.

15. The uplifted hands assist device of claim 12, wherein the vertical support member of the upper frame is made of a conduit.

16. The uplifted hands assist device of claim 12, wherein a material for making the vertical support member is selected from a group including metals, metal alloys, and plastics.

17. The uplifted hands assist device of claim 12, wherein a material for making the telescope tube is selected from a group including metals, metal alloys, and plastics.

* * * * *